US009845944B2

(12) United States Patent
Xu et al.

(10) Patent No.: US 9,845,944 B2
(45) Date of Patent: Dec. 19, 2017

(54) ELECTRONIC DEVICE, LED LAMP AND METHOD OF MANUFACTURING

(71) Applicant: PHILIPS LIGHTING HOLDING B.V., Eindhoven (NL)

(72) Inventors: Yunfei Xu, Eindhoven (NL); Yacouba Louh, Eindhoven (NL); Xiaolin Wang, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 15/107,287

(22) PCT Filed: Dec. 23, 2014

(86) PCT No.: PCT/EP2014/079111

§ 371 (c)(1),
(2) Date: Jun. 22, 2016

(87) PCT Pub. No.: WO2015/101551

PCT Pub. Date: Jul. 9, 2015

(65) Prior Publication Data

US 2017/0003013 A1 Jan. 5, 2017

(30) Foreign Application Priority Data

Jan. 2, 2014 (WO) ..... PCT/CN2014/000002
Jan. 6, 2014 (EP) ..... 14150185

(51) Int. Cl.
*F21V 29/70* (2015.01)
*F21V 29/83* (2015.01)
(Continued)

(52) U.S. Cl.
CPC ..... *F21V 29/70* (2015.01); *F21V 3/00* (2013.01); *F21V 23/003* (2013.01);
(Continued)

(58) Field of Classification Search
CPC ..... F21V 29/70; F21V 29/83
(Continued)

(56) References Cited

U.S. PATENT DOCUMENTS 7,521,872 B2 * 4/2009 Bruning ..... H05B 33/0821 315/149
2005/0174241 A1 8/2005 Olsen
(Continued)

FOREIGN PATENT DOCUMENTS

EP 2642176 A1 9/2013
WO WO2010140136 A1 12/2010
(Continued)

*Primary Examiner* — Toan Ly
(74) *Attorney, Agent, or Firm* — Akarsh P. Belagodu

(57) ABSTRACT

An electronic device (300) is provided, having a housing (301). The housing has a cooling chamber (342) and a wireless-communication chamber (344). The cooling chamber comprises an electronic circuit (310) embedded in potting material. The potting material is arranged to conduct heat away from the electronic circuit. The wireless-communication chamber comprises a radio-frequency (RF) antenna (320) for wirelessly receiving one or more commands controlling the electronic device. The cooling chamber and the wireless-communication chamber are physically separated so that the radio-frequency antenna is free from potting material wherein the cooling chamber and the wireless-communication chamber share a common separation wall (340) formed from a non-conducting material to separate the cooling chamber and the wireless-communication chamber, and the separation wall (340) forms a non-zero angle with respect to a top opening of the housing (301; 401). Eliminating potting material from the antenna by using separate chambers improves wireless transmission/reception efficiently. The design is suited for a lamp, in particular a LED lamp having an AC/DC converter which requires cooling in use. At least part of the housing may be formed from a
(Continued)

heat-dissipating material, the potting material being arranged to conduct heat away from the electronic circuit (310) to the heat-dissipating part of the housing.

15 Claims, 6 Drawing Sheets

(51) Int. Cl.

| | |
|---|---|
| ***H05B 37/02*** | (2006.01) |
| ***F21V 29/89*** | (2015.01) |
| ***F21V 3/00*** | (2015.01) |
| ***F21V 23/00*** | (2015.01) |
| *F21Y 115/10* | (2016.01) |

(52) U.S. Cl.
CPC ..... *F21V 23/006* (2013.01); *F21V 29/83* (2015.01); *F21V 29/89* (2015.01); *H05B 37/0272* (2013.01); *F21Y 2115/10* (2016.08)

(58) Field of Classification Search
USPC ..... 362/294, 373
See application file for complete search history.

(56) References Cited

U.S. PATENT DOCUMENTS

2006/0002110 A1* 1/2006 Dowling ..... F21K 9/00 362/249.05
2011/0193464 A1* 8/2011 Plawski ..... H01J 7/24 313/47
2012/0274208 A1* 11/2012 Chen ..... H01Q 1/38 315/34

FOREIGN PATENT DOCUMENTS

WO WO2013042009 A1 3/2013
WO WO2013103898 A1 7/2013
WO WO2013155446 A1 10/2013

* cited by examiner

ELECTRONIC DEVICE, LED LAMP AND METHOD OF MANUFACTURING

CROSS-REFERENCE TO PRIOR APPLICATIONS

This application is the U.S. National Phase application under 35 U.S.C. §371 of International Application No. PCT/EP2014/079111, filed on Dec. 23, 2014, which claims the benefit of European Patent Application No. 14150185.8, filed on Jan. 6, 2014, and International Patent Application No. PCT/CN2014/000002, filed Jan. 2, 2014. These applications are hereby incorporated by reference herein.

FIELD OF THE INVENTION

The invention relates to an electronic device comprising a housing, wherein the housing comprises an electronic circuit embedded in potting material, the potting material being arranged to conduct heat away from the electronic circuit to a heat sink. The invention relates in particular to a LED lamp comprising an AC/DC converter. The invention further relates to a housing for an electronic device and to a method of manufacturing an electronic device.

BACKGROUND

A LED light fixture is disclosed in international patent publication WO2013155446 A1. The fixture comprises an electronic LED power circuitry within a chamber. The LED power circuitry includes a LED driver secured to the inner surface of a shell.

Driver components of the LED driver are encapsulated (potted) in a protective polymeric material in the chamber. Suitable examples of such protective polymeric encapsulating material include thermoplastic materials such as low-pressure injection-molded nylon, which protects driver from electrostatic discharge while conducting heat to facilitate cooling of the driver during operation.

Nowadays, wireless control of a lamp or the driver thereof is a technical trend, and therefore antenna is expected to be integrated into the lamp. For the ease of connection/assembling, the antenna is often integrated into a PCB board along with the RF circuit which connects to the driver. In this case, a wireless signal can be received by the antenna on the PCB which is fully enclosed within the chamber along with RF circuit for wireless control of the fixture. The RF circuit along with the antenna is often placed near the LED driver.

SUMMARY OF THE INVENTION

A convenient way to apply potting to a driver of the light fixture is to fill the chamber housing the driver with potting thus encapsulating the driver. The potting will then also cover the antenna and reduce the performance of the antenna, e.g., by blocking or influencing the transmission or reception of the antenna. The electrical and magnetic properties of potting result in absorption of the desired radiation and detuning of the antenna. Therefore the wireless signal carrying the control information is weakened and the associated communication range is degraded.

It would be advantageous to have an improved electronic device with improved wireless transmission/reception yet allowing cooling of an electronic circuit using potting material. It would be also advantageous to provide a structure that enables easy assembly of the antenna and the driver with potting material.

FIGS. 1*a* and 1*b*, discussed below, show a design for a LED lamp in which foam shields the antenna from potting material. The LED Driver and antenna are placed in a single chamber. A foam block is applied over the antenna before potting material is received in the chamber. Although this design overcomes some of the problems associated with potting material, the design may be further improved.

An electronic device is provided by an embodiment of the invention for addressing these and other concerns. The electronic device comprises a housing. The housing has a cooling chamber and a wireless-communication chamber. The cooling chamber comprises an electronic circuit embedded in potting material. The potting material is arranged to conduct heat away from the electronic circuit. The wireless-communication chamber comprises a radio-frequency antenna for wireless sending or receiving information. For example, the electronic device may be configured to receive one or more commands controlling the electronic device through the antenna. The cooling chamber and the wireless-communication chamber are physically separated so that the radio-frequency antenna is free from potting material, wherein the cooling chamber and the wireless-communication chamber share a common separation wall formed from a non-conducting material to separate the cooling chamber and the wireless-communication chamber, and the separation wall forms a non-zero angle with respect to a top opening of the housing.

The housing has two physically separated chambers. The cooling chamber can be filled with potting material without the antenna contacting the potting material that would degrade the wireless signals used in reception and transmission. Wireless reception/transmission is improved, parts are reduced and manufacture is simplified. No foam is needed.

Having two chambers allows the potting to take place in the housing; this ensures a better heat dissipation by the potting material and reduces manufacturing steps.

In electronics, potting is a process of filling a complete electronic assembly with a solid or gelatinous compound, known as potting material. Potting material is also referred to as 'potting glue'. Thermo-setting plastics or silicone rubber gels may be used for this purpose. The potting material conducts heat away from the electronic assembly.

In an embodiment, the electronic device is a lamp comprising a light emitter and the electronic circuit comprises an AC/DC converter. Through the wireless communication, the lamp can be controlled, for example, to change a quality of the light, e.g.: on or off; the color of the light; the light intensity. On the other, hand the lamp can send information back, e.g., status information like temperature of the lamp, an indication that the lamp is broken, an indication that commands have been received correctly, etc.

In an embodiment, the electronic device the light emitter is a LED, and the electronic AC/DC converter is a LED driver. Therefore this embodiment is well suited for a LED luminaire, since it provides both good wireless communication and heat dissipation for the LED luminaire. In an embodiment, the housing comprises a heat sink, the potting material is arranged to conduct heat away from the electronic circuit to the heat sink. The heat sink may be arranged next to, or near, the cooling chamber.

In an embodiment, the housing has a cylindrical shape with a top plane carrying the top opening and a lateral surface, said top opening is for carrying the Light Emitting Diode, and the separation wall is perpendicular with respect to the top opening. In this embodiment, since the separation wall is perpendicular with respect to the top opening, placing the electronic circuit and potting material, as well as placing the antenna, into the housing are made relatively easy, thus the assembly is simple.

In an embodiment, the housing has an outer surface, at least part of which is of a heat-dissipating material to form a heat sink. The potting material is arranged to conduct heat away from the electronic circuit to the heat-dissipating part of the outer surface. Thus the electronic circuit is cooled in operation.

In an embodiment, the housing comprises an inner-surface, and the cooling chamber and the wireless-communication chamber share a common separation wall. The inner-surface and the separation wall defined the cooling chamber and the wireless-communication chamber. Together the inner-surface and the separation wall may form an inner-housing which may be integrally formed. This arrangement is both safe and easy to manufacture. Alternatively, the inner surface can have non-contacting cooling chamber and wireless-communication chamber.

In an embodiment, the inner surface is integrally formed with the separation wall; or the separation wall is an insert held by the inner surface, say inserted into the inner surface, clamped or glued thereto, etc. These embodiments provide at least two distinct ways of forming the separation wall, and both ways are simple and low cost.

In an embodiment, the housing comprises an inner cylindrical housing of a non-conducting material and an outer housing tapped toward said inner cylindrical housing, the inner-housing defining the wireless-communication chamber and the cooling chamber, the cooling chamber having a mount opening for receiving a mount for receiving electrical power. This embodiment provides a more specific structure of accessing the power input, said mount opening is formed on a bottom plane of the inner cylindrical housing distal from said outer housing and the top plane of the outer housing distal from said inner cylindrical housing is for carrying the light emitting diode.

In an embodiment, the electronic device comprises a mount, say a screw mount, for receiving alternating current from an electronic power supply, the electronic circuit being arranged to receive the alternating current from the mount.

In an embodiment, the electronic device comprises a wireless communication circuit connecting to the antenna for communicating the command of a wireless signal via the antenna, and the wireless communication circuit and the antenna are on a circuit board being comprised in the wireless-communication chamber. This embodiment provides more specific structure of the radio communication of electronic device.

In an embodiment, the wireless communication circuit connects to the electronic circuit via an electrical connection across the cooling chamber and the wireless-communication chamber, for power and information exchange. This embodiment provides more specific connection between the radio communication part and driving/power part of the electronic device.

In an embodiment, the multiple ribs project from the inner surface into the cooling chamber and/or the wireless-communication chamber. In particular, the separating wall may extend from a first rib of the multiple ribs to a second rib of the multiple ribs. In an embodiment, the one or more of the ribs have a connecting hole at the top, e.g., to receive a screw or a pin which fixes a lighting part onto the housing. The lighting part comprises one or more light emitters, for example LEDs, and possibly a heat spreader.

An aspect of the invention relates to a luminaire comprising an electronic device as described herein. An aspect of the invention relates to a housing for use in an electronic device as described herein.

An aspect of the invention relates to a method of manufacturing an electronic device. The method comprising forming a housing having a cooling chamber and a wireless-communication chamber, wherein the cooling chamber and the wireless-communication chamber share a common separation wall formed from a non-conducting material to separate the cooling chamber and the wireless-communication chamber, and the separation wall forms a non-zero angle with respect to a top opening of the housing, placing an electronic circuit in the cooling chamber, placing a radio-frequency (RF) antenna in the wireless-communication chamber, the radio-frequency (RF) antenna being configured for wireless receiving one or more commands controlling the electronic device, and filling the cooling chamber with potting material, embedding the electronic circuit, the potting material being arranged to conduct heat away from the electronic circuit to a heat sink, wherein the cooling chamber and the wireless-communication chamber are physically separated so that the radio-frequency antenna remains free from potting material.

Thus, an electronic device is provided, having a housing. The housing has a cooling chamber and a wireless-communication chamber. The cooling chamber comprises an electronic circuit embedded in potting material. The potting material is arranged to conduct heat away from the electronic circuit to a heat sink. The wireless-communication chamber comprises a radio-frequency (RF) antenna for wirelessly receiving one or more commands controlling the electronic device. The cooling chamber and the wireless-communication chamber are physically separated so that the radio-frequency antenna is free from potting material. Eliminating potting material from the antenna using separate chambers improves wireless reception efficiently. The design is suited for a lamp, in particular a LED lamp having a power source such as an AC/DC converter and/or DC/DC converter which requires cooling in use. At least part of the housing may be formed from a heat-dissipating material, the potting material being arranged to conduct heat away from the electronic circuit to the heat-dissipating part of the housing.

BRIEF DESCRIPTION OF THE DRAWINGS

These and other aspects of the invention are apparent from and will be elucidated with reference to the embodiments described hereinafter. In the drawings.

Figure 1A:
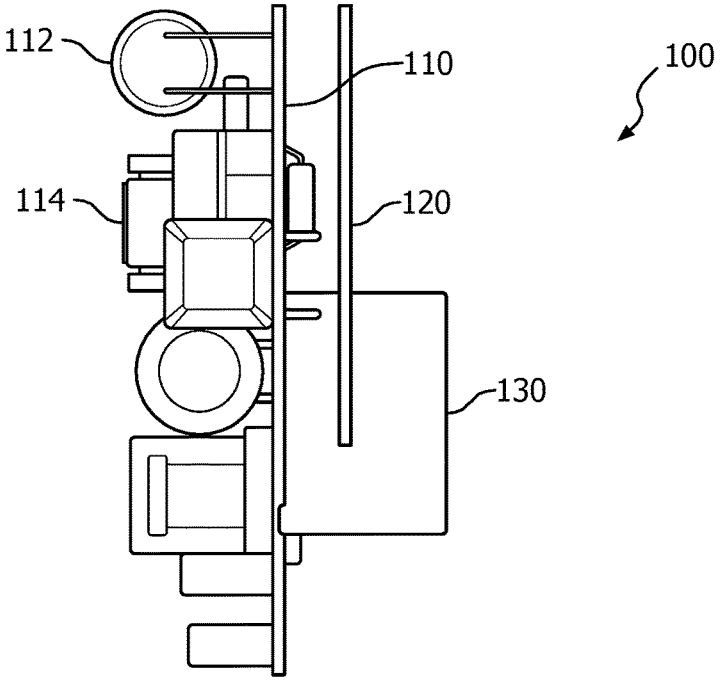
FIG. 1*a* is a side view of an electronic circuit and an antenna for use in the housing of FIG. 1*b*.

It should be noted that items which have the same/similar reference numbers in different Figures, have the same/similar structural features and the same/similar functions, or are the same/similar signals. Where the function and/or structure of such an item has been explained, there is no necessity for repeated explanation thereof in the detailed description.

LIST OF REFERENCE NUMERALS IN FIGS. 1-5

100 an electronic system comprising the electronic circuit and the RF antenna
110 AC/DC driver of the electronic circuit
112 a capacitor of the electronic circuit
114 a transformer of the electronic circuit
120 RF antenna
130 a foam block
140 a chamber
150 a housing
200 an electronic device
201 a lamp
210 an electronic circuit
220 an antenna
230 mount opening
240 a separating wall
242 a cooling chamber
244 an RF chamber
252 a heat sink
262 a heat spreader
264 a light emitting device
300 LED lamp
301 a housing
302 direction indicator, arrow points to top
310 the electronic circuit with AC/DC driver (contained in a circuit board)
320 the RF antenna and wireless communication circuit (contained in a circuit board)
322 an electrical connection
330 mount opening
332 a coating
340 separating wall
342 a cooling chamber
344 RF chamber
352 outer surface
354 inner surface
356 top opening
400 LED lamp
401 a housing
500 a luminaire
510 an upper lamp body
520 a lower seat

DETAILED DESCRIPTION OF EMBODIMENTS

While this invention is susceptible of embodiment in many different forms, there is shown in the drawings and will herein be described in detail one or more specific embodiments, with the understanding that the present disclosure is to be considered as exemplary of the principles of the invention and not intended to limit the invention to the specific embodiments shown and described.

Figure 1B:
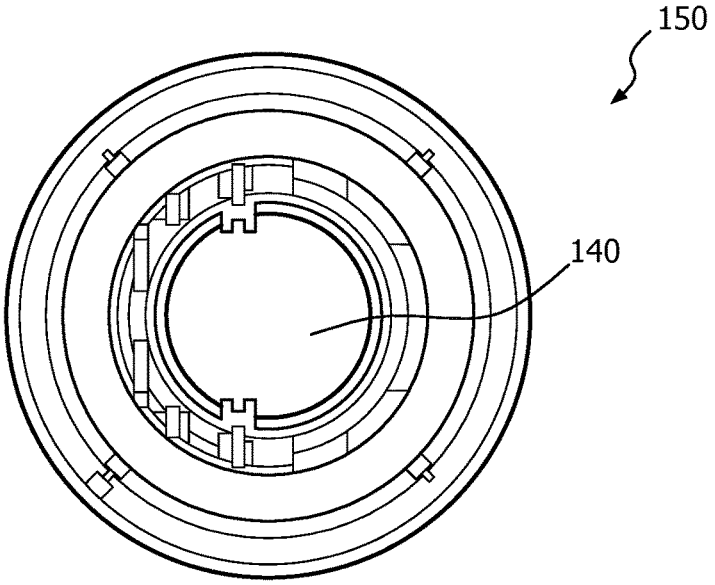
FIG. 1*b* is top view of a housing with a single chamber containing both of the electronic circuit and the antenna.

FIGS. 1*a* and 1*b* show a design for a LED lamp that does not have a physically separated cooling chamber and a wireless-communication chamber. FIG. 1*a* is a side view of an electronic system 100 for use in housing 150 shown in FIG. 1*b*. FIG. 1*b* is top view of a housing with only one chamber. A design with a single chamber housing both driver and antenna has improved reception if it uses some means to avoid potting material at the antenna. In FIGS. 1*a* and 1*b* this is achieved my means of a foam block 130.

System 100 comprises an electronic circuit with AC/DC driver 110 and an RF antenna 120. For example, FIG. 1*a* shows an electronic circuit comprising, e.g., a capacitor 112 and a transformer 114, as a part of the AC/DC converter 110. It should be understood that the electronic circuit may comprises other power components that need cooling such as a DC/DC converter. Housing 150 has a single chamber 140 for receiving system 100. On top of housing 150 a LED is placed, powered and controlled by system 100.

The electronic circuit such as AC/DC driver 110 heats in operation and needs cooling to prolong the life of system 100. The cooling is achieved by filling chamber 140 with potting material, i.e., a thermal conductive material. The potting material spreads the heat of the components of system 100 to housing 150. Unfortunately, the thermal conductive material (potting glue) impacts the antenna.

Contact between potting material and an antenna for wireless reception is problematic for at least two reasons. First of all, the potting material absorbs part of the radio signals intended for the antenna. Second, the potting material changes the tuning, namely the radio frequency from the antenna. Both problems decrease reception/transmission. These problems may be addressed, e.g., by a more elaborate tuning procedure, increased power at a radio transmitter, and/or error-correction procedures. The design shown in FIG. 1*a* shows another solution.

A foam block 130 is applied to cover the antenna avoiding that potting material comes into contact with the RF antenna. For example, a slit is made in the block of foam 130. Foam 130 is arranged around RF antenna 120 before the emersion of system 100 in potting material in the single chamber; in this case by sliding the part of the circuit board containing the antenna into the slit before potting. After system 100 is placed in chamber 140, with foam block 130 in place, chamber 140 is filled with potting material to cool AC/DC driver 110. Foam 130 protects antenna 120 from immersion in the potting material. This design stops potting material from contacting the RF antenna. Wireless reception/transmission is improved. The foam is preferably a solid foam not a liquid foam.

Nevertheless solution proved not entirely satisfactory. First of all, just like the potting material, also the foam block changes the tuning of antenna 120. This degrades reception/transmission. Furthermore the foam block is not entirely stable, making the tuning less reliable. The severity of the tuning problem depends on the type of foam used, but has been observed with all tried types of foam. Second, the solution is very labor intensive. The design proved difficult to automate, requiring each foam block to be placed by hand.

Figure 2A:
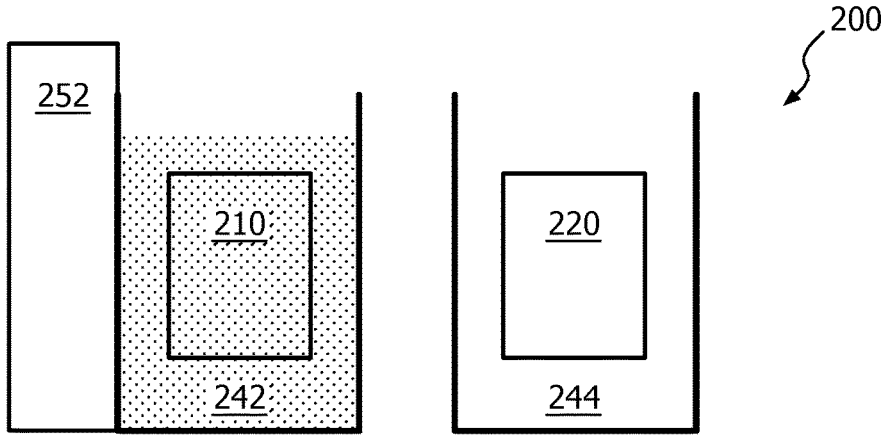
FIG. 2*a* is a schematic illustration of an electronic device according to an embodiment of the invention.
Figure 2B:
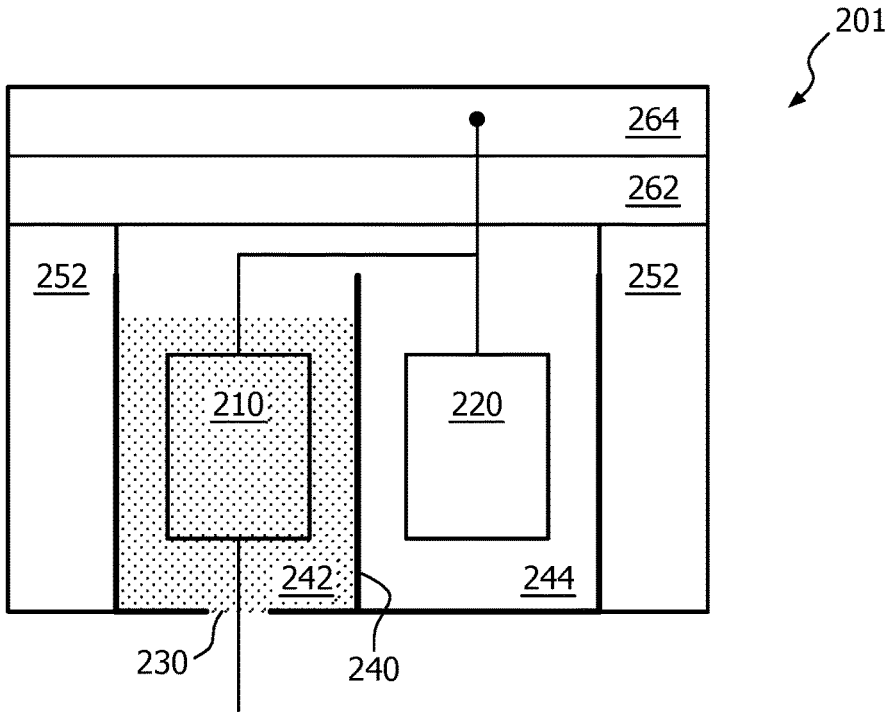
FIG. 2*b* is a schematic illustration of a LED lamp according to an embodiment of the invention.

FIGS. 2*a* and 2*b* illustrate an improved concept according the embodiment of the invention. FIG. 2*a* is a schematic illustration of an electronic device 200.

Electronic device 200 comprises a housing having a cooling chamber 242 and a wireless-communication chamber 244. Cooling chamber 242 comprises an electronic circuit 210 embedded in potting material. The potting material has been illustrated in FIG. 2 as a background texture in chamber 242. Electronic device 200 comprises a heat sink 252. The potting material in cooling chamber 242 is arranged to conduct heat away from the electronic circuit to heat sink 252. Heat sink 252 is shown at one side of cooling chamber 242, but may be located at any side of cooling chamber 242. RF chamber 244 is not filled with potting material, thus could be considered as filled with air. RF chamber 244 comprises a radio-frequency (RF) antenna 220 for wireless communication between an external wireless device (not shown) and electronic device 200. The communication is may be transmitting or receiving in only one direction, or may be transceiving in two directions. More specifically, antenna 220 may be used for wirelessly receiving one or more commands controlling electronic device 200. Conversely, antenna 220 may be used for wirelessly sending information, e.g., status information from electronic device 200 to the external wireless device. Electronic device 200 may be used as a sensor; the information may contain sensing information.

Cooling chamber 242 and RF chamber 244 are physically separated so that the radio-frequency antenna is free from potting material. Potting material negatively impacts antenna 220, because of absorption of the radio signal and/or disturbing the tuning of antenna 220. Heat sink 252 may be part of the housing, e.g. surrounding all or part of electronic device 200. Heat sink 252 may be made of metal, e.g., aluminum.

FIG. 2*b* is a schematic cross-section of a lamp 201. Lamp 201 contains the same elements as FIG. 2*a*, with the following differences.

Lamp 201 comprises a light emitter 264, e.g., a LED, possibly in the form of a LED die or array. Lamp 201 comprises a heat spreader 262 below light emitter 264. Heat spreader transfers heat generated by light emitting device 264 to heat sink 252. Note that heat spreader 262 and the potting material in cooling chamber 242 may not make contact; in FIG. 2*b* there is an air gap between heat spreader 262 and the potting material; this is suited for a LED lamp. Also the potting material and heat sink 252 do not need to make direct contact, e.g. in FIG. 2*b* they are separated by an inner surface. Nevertheless, there is a heat conducting path from the potting glue to the heat sink, e.g., by placing the heat sink in direct, or close, contact with the cooling chamber. In an embodiment, the heat sink is omitted, this may be done, e.g., if the cooling requirements of the electronic circuit are sufficiently small.

Heat sink 252 is arranged with respect to the cooling chamber so that the potting material may conduct heat from circuit 210 to the heat sink. This may be achieved if heat sink 252 surrounds both chambers, as shown in FIG. 2*b*. This is not necessary though. As there is no potting material in chamber 244, there is no need to arrange the heat sink next to it, from the viewpoint of cooling, and that would even further improve wireless reception. However to manufacture device 201, it is easier to surround both chambers by the heat sink.

Electronic circuit 210 comprises an AC/DC converter and/or other possible driving circuit such as DC/DC converter, possibly having an additional controlling unit. Cooling chamber 242 comprises a mount opening 230. A mount (not shown) may be arranged on mount opening 230 for receiving electrical power. Heat sink 252 may surrounds lamp 201 and form an outer surface of lamp 201. Heat sink 252 is formed from a heat-dissipating material, for example thermally conducting material.

Lamp 201 comprises an inner-housing indicated by a thicker line than the heat sink. The inner housing comprises a separating wall 240 and an inner surface contacting heat sink 252. The inner housing is made from an electrically non-conducting material, i.e. an electrical isolator. FIG. 2*b* shows a power supply running from cooling chamber 242 to wireless communication chamber 244. Control logic for controlling lamp 201 in response to received commands may be placed in circuit 210 or circuit 220.

Figure 3A:
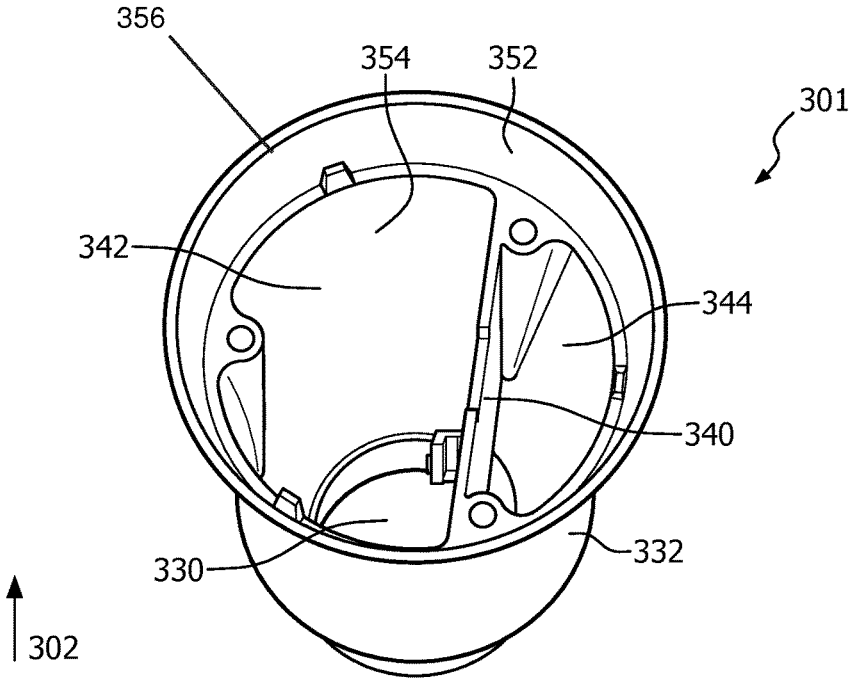
FIG. 3*a* is a line drawing of a housing according to an embodiment of the invention.
Figure 3B:
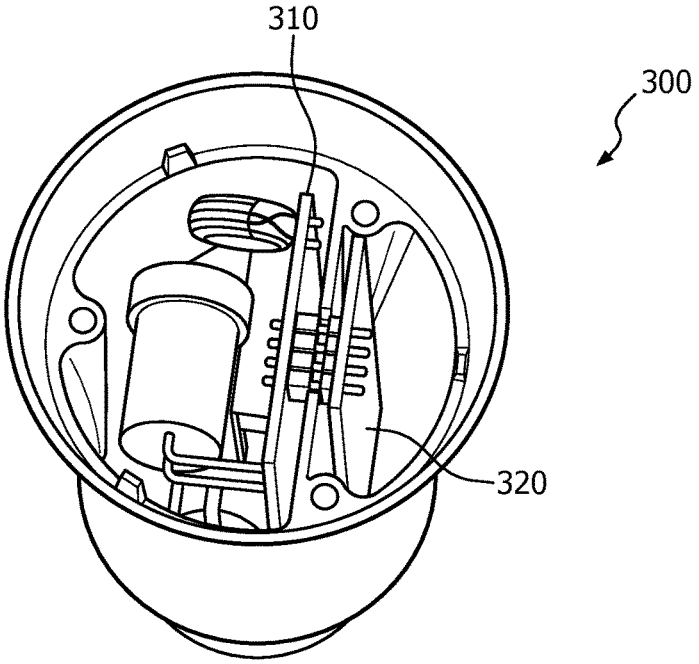
FIG. 3*b* is the housing of FIG. 3*a* including a LED driver and a wireless communication circuit.

A further embodiment is described below. FIG. 3*a* shows a housing for use with an electronic device. FIG. 3*b* shows an electronic device having the housing, which is separately shown in FIG. 3*a*. For example, one may assemble system 100 in the housing. FIG. 3*b* includes the housing of FIG. 3*a* encompassing a circuit board (left) carrying an electronic circuit including the LED driver and another circuit board (right) carrying a wireless communication circuit and the antenna. FIGS. 3*a* and 3*b* are discussed together and are referred to as FIG. 3. Arrow 302 points towards the top of the device, away from a mount. FIG. 3 is a further refinement of FIG. 2.

FIG. 3 shows a LED lamp 300. A LED lamp is an example of a lamp and in particular of an electronic device. The use of a separate cooling chamber and wireless-communication chamber is well-suited to LED Lamps. However the design may be applied more generally. In FIG. 3 only one part of LED lamp 300 is shown. Absent from FIG. 3 is a light emitting device, e.g. a LED, and optical components such as lens, diffusers and the like, etc. The light emitting device and optical components may be arranged on top of the part shown in FIG. 3, possibly a heat spreader may be arranged between the LED and the housing shown in FIG. 3. These components are not discussed in further detail in the present application.

FIG. 3 shows a housing 301, the housing has a top opening 356 facing the reader. The housing has a cooling chamber 342 and a wireless-communication chamber 344. The wireless-communication chamber 344 will also be referred to as RF chamber 344. Cooling chamber 342 is configured to receive the circuit board carrying the electronic circuit. RF chamber 344 is configured to receive the circuit board carrying a radio-frequency (RF) antenna 320, and in preferable embodiment the RF chamber also receives the wireless communication circuit. The housing has a cylindrical shape with a top plane carrying the top opening and a lateral surface 332, said top opening is for carrying the Light Emitting Diode.

In LED lamp 300, cooling chamber 342 comprises potting material embedding the electronic circuit 310. The potting material conducts heat away from electronic circuit 310, preferably to a heat sink which will be discussed later. The wireless-communication chamber comprises a radio-frequency (RF) antenna 320 for wireless communicating, say, one or more commands to or from the electronic device. The two chambers, i.e., cooling chamber 342 and RF chamber 344, are physically separated so that the radio-frequency antenna is free from potting material. As noted, contact between potting material and an antenna for wireless reception is problematic. The design contained herein addresses these and other problems. In a variant, the electronic circuit comprises a DC/DC converter in addition or instead of the AC/DC converter.

Housing 301 comprises an outer surface 352. At least part of outer surface 352 is formed from a heat-dissipating material to form the heat sink. The heat sink comprises the heat-dissipating part of the outer surface. Heat-dissipating materials are typically thermally conducting. Suited materials are metals, e.g., copper, or aluminum, etc. In an embodiment, outer surface 352 is formed completely from the heat-dissipating material. The latter, although convenient, is not necessary, for example, outer surface 352 may comprise a metal-band. For example, outer surface 352 may be partially metallic except at the outside of RF chamber 344, say as a three-quarter band.

In this embodiment, outer surface 352 has an axis (not shown) around which outer surface 352 is symmetrical. For example, outer surface 352 may be defined as a so-called surface of revolution with respect to the axis. For example, outer surface 352 could be a cylinder, say a metal cylinder. Outer surface 352 may be wider at the top than at the bottom.

Outer surface 352 may have a coating 332, say a paint coating. Preferably, coating 332 does not impede the head dissipating function of outer surface 352. Coating 332 may contain a sign, for instance a brand name as shown in the FIG. 3, part number or the like. Coating 332 may be paint or laser engraving. It should be understood that coating 332 is not essential to the embodiment of the invention and is optional.

Housing 301 comprises an inner-surface 354 formed from a non-conducting material, outer and inner surface contacting each other along a common surface. In FIG. 3, the inner surface runs along the inside of the entire of outer surface 352, except for a band at the top. The band at the top may receive a heat spreader. Plastic is suitable for inner surface 354.

Housing 301 comprises a separation wall 340. Cooling chamber 342 and the wireless-communication chamber 344 share separating wall 340 as a common separation wall. Also RF chamber 344 may be made from a non-conducting material. The separation wall 340 forms a non-zero angle with respect to the top opening 356 of the housing, and in the particular embodiment, the separation wall 340 is perpendicular with the top opening 356 of the housing.

In FIG. 3, housing 301 comprises an inner-housing formed by inner surface 354 and separating wall 340. The inner-housing defines cooling chamber 342 and separating wall 340. Note that the top of the two chambers are open in FIG. 3, at this point the chambers may be closed by a heat spreader. Cooling chamber 342 has a mount opening 330, opposite to the top opening 356, for receiving a mount for receiving electrical power. Mount opening 330 may be at the bottom of cooling chamber 342. Bottom of RF chamber 344 is closed, preferably, before cooling chamber 342 receives potting material.

The inner-housing may comprise multiple independently formed components. For example, in an embodiment, housing 301 comprises a plastic ring, forming inner surface 354, and a separate separating wall 340. Separating wall 340 may be made from a different material, say a different plastic. The inner housing may comprise additional components, for example, in an embodiment, the bottom of RF chamber 344 is closed, say by a further part, or RF chamber 344 may be glued closed. Closing the bottom of RF chamber 344 avoids potting material to enter from cooling chamber 342 via the bottom.

The inner housing is suited to be integrally formed. For example, the inner housing may be molded from a plastic, say using injection molding or other molding process. The integrally formed housing comprises inner surface 354 and separating wall 340. The inner housing may have further parts, for example, FIG. 3*a* shows ribs for receiving the remaining parts of LED lamp 300. Separating wall 340 may project from inner surface 354.

FIG. 3 shows a number of ribs projecting from the inner surface into the inner housing. In this embodiment, there are three ribs: one projects into cooling chamber 342, and two into RF chamber 344. There may be more or fewer ribs.

The ribs are suitable for combination with separating wall 340. FIG. 3*a* shows, multiple ribs, e.g., 3, projecting from the inner surface, the separating wall extending from a first rib of the multiple ribs to a second rib of the multiple ribs. In FIG. 3, the top of the ribs have a connecting hole, e.g., to receive a screw or a pin. The connecting hole may be use to connect the remainder of the lamp 300, e.g., to connect a heat spreader and light emitting device.

Combining ribs with the projecting wall proved suitable to increase to support both separating wall 340 and the inner housing. At the same time the ribs may be used to connect further parts to the inner housing.

LED lamp 300 comprises an electric mount for receiving alternating current from an electronic power supply. For example, AC/DC driver may comprise one or more transformers and/or capacitors. AC/DC driver is arranged to receive the alternating current from the mount. For example, the mount may be a screw mount. The screw mount may be standard mount, say a E27 mount, etc. The mount connects with mount opening 330 so that AC/DC driver may receive alternating current from the mount. Instead of screw mounts, other connecting mounds may be used. FIG. 3*a* shows mount opening 330. In FIG. 3*b* a screw mount is just visible at the bottom.

FIG. 3*b* shows how housing 301 may comprise the electronic circuit with the AC/DC driver and the wireless communication circuit and antenna. The antenna is connected to the wireless communication circuit and both of them are placed on a circuit board. The antenna may be made as a saw tooth trace/meander line on the circuit board, and the trance/line connects to the wireless communication circuit directly. Wireless communication circuit may be configured to realize ZigBee communication. Other options include Wi-Fi, Bluetooth, wireless USB and the like. In FIG. 3, LED lamp 300 comprises a wireless communication circuit for obtaining the command from a wireless signal received by the antenna, the wireless communication circuit being comprised in the wireless-communication chamber.

Cooling chamber 342 is filled with potting material (not shown). The potting material transfers heat created by AC/DC driver during operation towards a heat sink, i.e., towards outer surface 352. RF chamber 344 is not filled with potting material. Accordingly, the potting material will not impact the wireless reception of the antenna. Cooling chamber 342 containing the ACDC driver still receives potting material. The potting material contacts both the AC/DC driver and the inner surface, in this ways the potting material conducts heat away from AC/DC driver to the inner surface. Immediately behind the inner surface is a heat sink, so that the potting material conducts heat to the heat sink. Ideally, all parts of AC/DC driver that need cooling are embedded.

These components have a longer life time due to improved the thermal performance. For example, the effect of heat on the capacitor is of particular concern, as the life of a capacitor can be drastically reduced when operated in a high temperature environment, leading to a higher potential for failure. At the same time, a high quality RF performance is obtained given a better wireless connection between LED lamp 300 and a transmitter, say a hub. Having two independent chambers requires no foam, yet the RF signal is better compared to the foam design. LED lamp 300 is easier to assemble compared to housing 150. There are fewer parts in FIG. 3; moreover applying the foam in FIG. 1 proved difficult to automate.

Figure 3C:
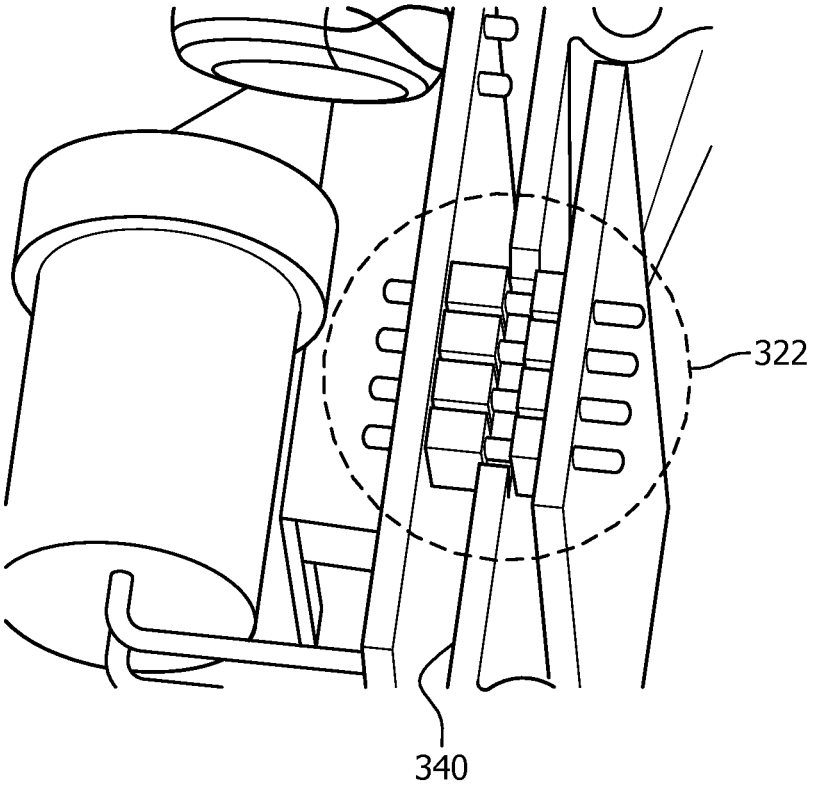
FIG. 3*c* shows a detail of FIG. 3*b*.

FIG. 3*c* shows a detail of FIG. 3*b*. Shown in FIG. 3*c* is an electrical connection 322 between the two circuit boards and across the two separate chambers. The connection is interlinking the electronic circuit with AC/DC driver and the antenna and wireless communication circuit and physically fixing them in parallel. For example, the connection 322 runs over the top of separating wall 340, outside the potting material. In an embodiment, the connection 322 is a so-called pluggable pin interface, and the circuit board of the electronic circuit with AC/DC driver, the circuit board of antenna and wireless communication circuit and connection 322 form a U-shape after the connection is plugged in. During assembly of the electronic device, the U-shape is positioned upside-down over the wall 340, and the opening of the U-shape receives the wall 340 with the two circuit boards being received in the respective chambers, before entering the potting material. It was found that running the connection 322 over wall 340 is convenient. Alternatively, separating wall 340 may comprises a hole through which connection 322 runs. In the latter case, the dimensions of connection 322 should be such that the connection fills the hole up, so that no potting material can enter into RF chamber 344. Other connections are also possible.

Antenna and wireless communication circuit may receive via the connection 322 from AC/DC driver electrical power to run antenna and wireless communication circuit. These may not require the same type of electrical power as the LED requires. AC/DC driver is arranged to produce both types of electrical power. In an embodiment, LED lamp 300 is controllable through wireless commands received through wireless communication circuit. Control logic arranged to control LED lamp 300, in particular the LED thereof, in response to wireless commands may be comprised in wireless communication circuit. The control logic adjusts the electric power running from AC/DC driver to the light emitting device. The wireless command may dim the lamp, or change its color. In this case, the wireless communication circuit with the control logic transmits the control signal such as dim level or the ratio of different color channel to the AC/DC driver via the connection 322. The connection 322 may be a multiple pin interface for transferring both the power supply and the control signal. Alternatively, the control logic is placed on the electronic circuit together with the AC/DC convertor. And in this case the wireless communication circuit transmits the received command to the control logic via the connection 322, and the control logic interprets the command into control signal to the driver.

In an embodiment, the electric power for the LED runs from AC/DC driver to wireless communication circuit over connection 322, and from wireless communication circuit to the LED. Wireless communication circuit adjusts the power if needed. This embodiment has the advantage that low-voltage electronics is concentrated in wireless communication circuit.

Alternatively, the electric power for the LED runs from AC/DC driver directly to the LED, not via wireless communication circuit, AC/DC driver adjusting the power if needed in response to commands received from wireless communication circuit over connection 322. This embodiment has the advantage that electronics in wireless communication circuit may be minimized, even to the point that wireless communication circuit contains only an RF circuit. A smaller wireless communication circuit has the advantage that more potting material may be used in cooling chamber 342 and thus cool AC/DC driver better.

In this embodiment, cooling chamber 342 comprises the electronic circuit 310 with an AC/DC driver, e.g. a LED driver. The AC/DC driver is a circuit configured to receive alternating current from an electronic power supply and to convert it to direct current. In this embodiment, AC/DC driver is used as a LED driver. A LED uses direct current instead of alternating current. In a more specific embodiment, a DC/DC converter is provided after the AC/DC converter and they form the LED driver together. The AC/DC and DC/DC converter produces heat during operation. To conduct the heat away from electronic circuit 310 to a heat sink, electronic circuit 310 is embedded in potting material. FIG. 3*b* shows the electronic circuit inside cooling chamber 342 but without the potting material. In operation, chamber 342 is filled with potting material.

There are many types of potting material. For LED lamp 300, thermal potting material (thermal potting glue) is used.

LED lamp 300 may also comprise a heat spreader (not shown). For example, LED lamp 300 may comprise a heat spreader arranged so that the heat spreader contacts the heat sink and conducts heat away from the light emitter to the heat sink. The heat generated by the LED(s) of LED lamp 300 are transferred to the surroundings by thermal conduction between the heat spreader and the heat sink; thus heat is spread from a high power density at the LED die level to a low power density over the total cooling area, i.e. surface of the heat spreader together with the heat sink. The low power density heat is then transferred via convection to the ambient air. The heat spreader need not contact the potting material.

Wireless communication circuit may comprise a microprocessor which executes appropriate software stored at the device 300, say at wireless communication circuit 320; for example, that software may have been downloaded and/or stored in a corresponding memory, e.g., a volatile memory such as RAM or a non-volatile memory such as Flash. Alternatively, LED lamp 300 may comprise programmable logic, e.g., as field-programmable gate array (FPGA) or an application specific integrated circuit (ASIC).

Figure 4A:
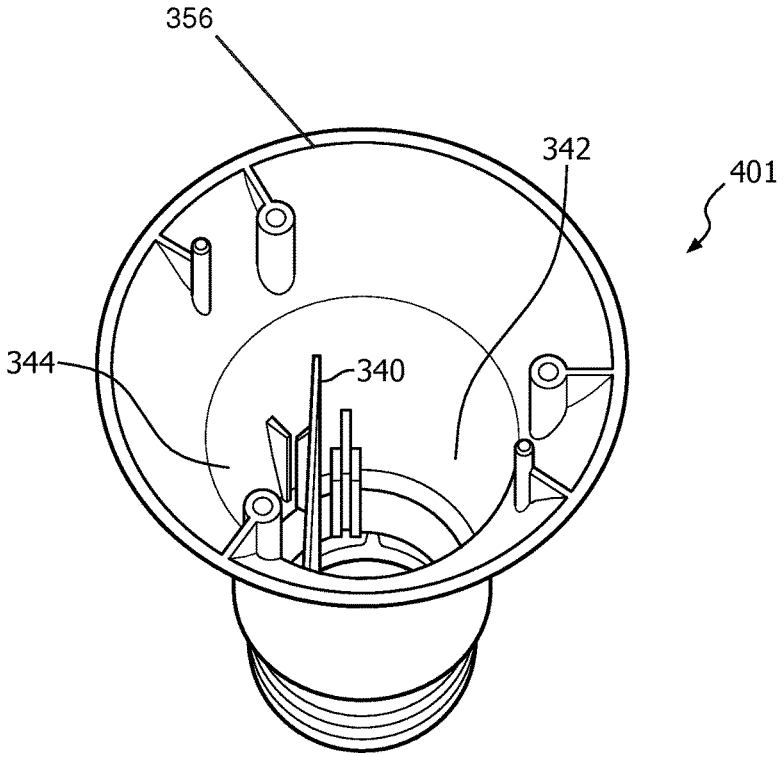
FIG. 4*a* is a line drawing of a housing according to another embodiment of the invention.
Figure 4B:
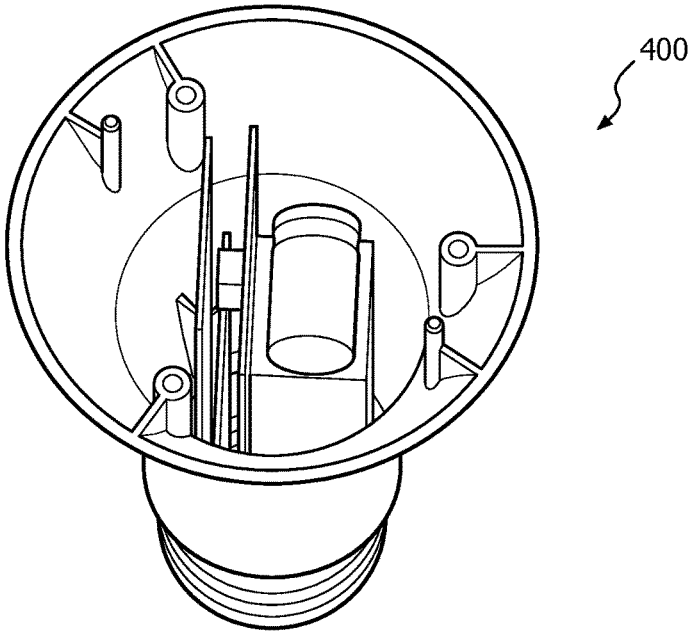
FIG. 4*b* is the housing of FIG. 4*a* including a LED driver and a wireless communication circuit, FIG. 5 schematically shows a luminaire.

In FIGS. 3*a* and 3*b*, the separation wall 340 is as high as the inner surface. FIGS. 4*a* and 4*b* show an alternative design for a LED lamp 400 having a housing 401, wherein the separation wall is only a part of, for example a half of the height of the inner surface. More specifically, the housing has an inner cylindrical housing of a non-conducting material and an outer housing tapped toward said inner cylindrical housing, the inner-housing defining the wireless-communication chamber and the cooling chamber.

In both FIGS. 3*a/b* and 4*a/b*, the separation wall is integrally formed with the inner surface.

There are many ways to mount the separation wall. For example, the separation wall may be an insert plate. The insert plate may be held in position by the inner surface, the inner surface having means for means holding the plate; for example, the means may be a recess, such as a slit, to receive the insert plate, or a clamp to hold the plate. The insert plate may be glued to the inner surface. A separation place, including an insertion plate may be also be used without an inner surface, e.g. arranged in the housing, say directly to the outer surface.

A LED lamp according to FIG. 2*b*, 3 or 4 is particularly suited for a multi-colored LED lamp combining one or more LEDs configured to produce light of a selectable color. The color may be selected through the wireless commands. For example, the LED lamp may mix green, red, and blue lights to obtain a large number of different colors. The lamp may be controlled using a smartphone or tablet; this allows control over the lamp wirelessly and remotely. Transmission of a command from a wireless device, such as a smart phone, may run first to a hub, say using the internet and/or a Wi-Fi network, and from the hub to the LED lamp, say using ZigBee or other wireless protocol.

Figure 5:
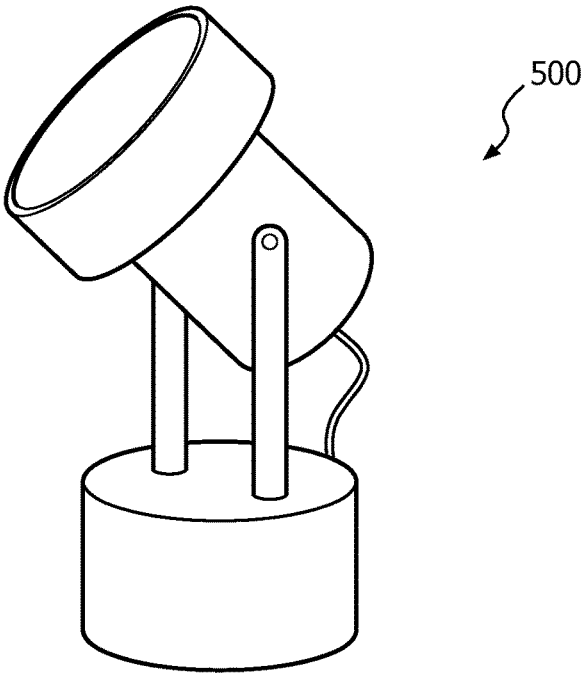

FIG. 5 schematically shows an embodiment of a luminaire 500. Luminaire 500 comprises a upper lamp body 510 and a lower seat 520. The luminaire 500 comprises one of the embodiments of the above discussed electronic device, in particular lamp or LED lamp embodiments. The electronic device can be placed within the upper lamp body 510 or within the lower seat 520. Many other types of luminaires are possible.

Figure 6:
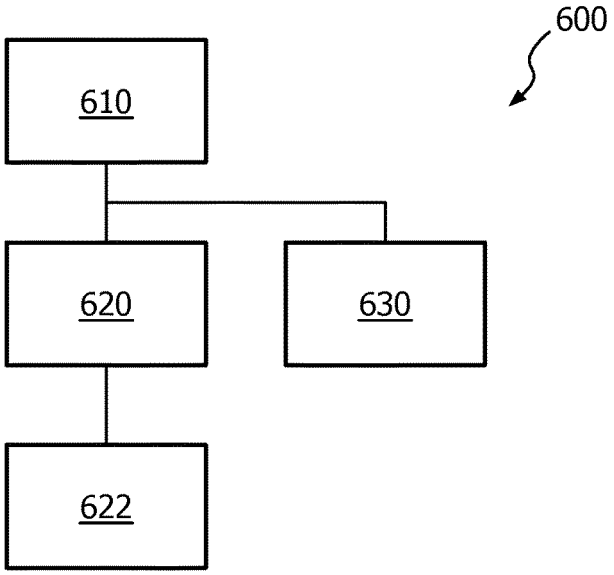
FIG. 6 is a schematic flow chart of a manufacturing method according to an embodiment of the invention.

FIG. 6 schematically illustrates a method 600 of manufacturing an electronic device, such a shown herein. Method 600 comprises:

Forming 610 a housing having a cooling chamber and a wireless-communication chamber, wherein the cooling chamber and the wireless-communication chamber share a common separation wall formed from a non-conducting material to separate the cooling chamber and the wireless-communication chamber, and the separation wall forms a non-zero angle with respect to an opening of the housing. The housing may be an embodiment of a housing shown herein, e.g. housing 301, housing 401 or any of its variants. For example, this step may include forming an inner housing and an outer surface, and connecting the outer surface around the inner housing, e.g., forcing or gluing the outer surface and inner housing together.

Placing 620 an electronic circuit in the cooling chamber, and placing 630 a radio-frequency (RF) antenna in the wireless-communication chamber. Steps 620 and 630 may be performed in a reverse order, in parallel and the like. The radio-frequency (RF) antenna is configured for wireless receiving one or more commands controlling the electronic device.

Filling 622 the cooling chamber with potting material, embedding the electronic circuit, the potting material being arranged to conduct heat away from the electronic circuit to a heat sink. The cooling chamber and the wireless-communication chamber are physically separated so that the radio-frequency antenna remains free from potting material.

Many different ways of executing the method are possible, as will be apparent to a person skilled in the art. For example, the order of the steps can be varied or some steps may be executed in parallel. Moreover, in between steps other method steps may be inserted. The inserted steps may represent refinements of the method such as described herein, or may be unrelated to the method. For example, steps 620, 630 and even 622 may be executed, at least partially, in parallel. Moreover, a given step may not have finished completely before a next step is started.

It should be noted that the above-mentioned embodiments illustrate rather than limit the invention, and that those skilled in the art will be able to design many alternative embodiments. For example, while the electronic circuit comprises an AC/DC converter, it can also comprise other electronic components without the AC/DC converter. As along as the electronic circuit is put in the cooling chamber and embedded by potting material for heat dissipation, such embodiment should fall into the scope of the invention.

In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. An electronic device comprising a housing, the housing having a cooling chamber and a wireless-communication chamber, wherein the cooling chamber comprises an electronic circuit embedded in potting material, the potting material being arranged to conduct heat away from the electronic circuit, the wireless-communication chamber comprising a radio-frequency antenna for wirelessly sending or receiving information, and the cooling chamber and the wireless-communication chamber are physically separated so that the radio-frequency antenna is free from the potting material, wherein the cooling chamber and the wireless-communication chamber share a common separation wall formed from a non-conducting material to separate the cooling chamber and the wireless-communication chamber, and the separation wall forms a non-zero angle with respect to a top opening of the housing.

2. An electronic device as in claim 1, wherein the electronic device is a lamp comprising a light emitter.

3. An electronic device as in claim 2, wherein the light emitter is a Light Emitting Diode.

4. An electronic device as in claim 3 wherein the electronic circuit is a LED driver comprising an AC/DC converter.

5. An electronic device as in claim 4 comprising a wireless communication circuit connected to the antenna for sending or receiving the information through a wireless signal via the antenna, wherein the wireless communication circuit and the antenna are on the same circuit board comprised in the wireless-communication chamber.

6. An electronic device as in claim 5, the wireless communication circuit and the electronic circuit are electrically connected and physically fixed parallel with each other via an electrical connection across the separation wall, said electrical connection for power and information exchange between the electronic circuit and the wireless communication circuit.

7. An electronic device as in claim 3, wherein the housing has a cylindrical shape with a top plane carrying the top opening and a lateral surface, said top opening is for carrying the Light Emitting Diode, and the separation wall is perpendicular with respect to the top opening.

8. An electronic device as in claim 7, wherein the inner surface is integrally formed with the separation wall; or the separation wall is an insert held by the inner surface.

9. An electronic device as in claim 3, wherein the housing has an outer surface, at least part of which is of a heat-dissipating material to form a heat sink, the potting material being arranged to conduct heat away from the electronic circuit to the heat-dissipating part of the outer surface.

10. An electronic device as in claim 9, wherein the housing further comprises an inner-surface formed from a non-conducting material, outer and inner surface contacting each other along a common surface.

11. An electronic device as in claim 10, wherein the cooling chamber and the wireless-communication chamber are defined by at least the inner surface.

12. An electronic device as in claim 3 wherein the housing comprises an inner cylindrical housing of a non-conducting material and an outer housing tapped toward said inner cylindrical housing, the inner-housing defining the wireless-communication chamber and the cooling chamber, the cooling chamber having a mount opening for receiving a mount for receiving electrical power, said mount opening is formed on a bottom plane of the inner cylindrical housing distal from said outer housing and the top plane of the outer housing distal from said inner cylindrical housing is for carrying the light emitting diode.

13. A luminaire comprising an electronic device as in claim 1.

14. A housing for an electronic device, the housing having a cooling chamber and a wireless-communication chamber, wherein the cooling chamber is configured to comprise an electronic circuit and to receive potting material embedding the electronic circuit, the housing being arranged for the potting material to conduct heat away from the electronic circuit, the wireless-communication chamber is configured to comprise a radio-frequency (RF) antenna for wireless sending or receiving information, and the cooling chamber and the wireless-communication chamber are physically separated so that the radio-frequency antenna remains free from potting material when the cooling receives the potting material, wherein the cooling chamber and the wireless-communication chamber share a common separation wall formed from a non-conducting material to separate the cooling chamber and the wireless-communication chamber, and the separation wall forms a non-zero angle with respect to an opening of the housing.

15. Method of manufacturing an electronic device comprising forming a housing having a cooling chamber and a wireless-communication chamber, wherein the cooling chamber and the wireless-communication chamber share a common separation wall formed from a non-conducting material to separate the cooling chamber and the wireless-communication chamber, and the separation wall forms a non-zero angle with respect to an opening of the housing, placing an electronic circuit in the cooling chamber, placing a radio-frequency antenna in the wireless-communication chamber, the radio-frequency antenna being configured for wireless sending or receiving information, and filling the cooling chamber with potting material, embedding the electronic circuit, the potting material being arranged to conduct heat away from the electronic circuit, wherein the cooling chamber and the wireless-communication chamber are physically separated so that the radio-frequency antenna remains free from potting material.

* * * * *